US005091108A

United States Patent [19]

Harder et al.

[11] Patent Number: 5,091,108

[45] Date of Patent: Feb. 25, 1992

[54] METHOD OF RETARDING CORROSION OF METAL SURFACES IN CONTACT WITH BOILER WATER SYSTEMS WHICH CORROSION IS CAUSED BY DISSOLVED OXYGEN

[75] Inventors: Scott R. Harder, Naperville; Cynthia A. Soderquist, Bolingbrook; Claudia C. Pierce, Lisle, all of Ill.

[73] Assignee: Nalco Chemical Company, Naperville, Ill.

[21] Appl. No.: 658,732

[22] Filed: Feb. 21, 1991

[51] Int. Cl.[5] ..... C23F 11/12; C23F 11/14

[52] U.S. Cl. ..... 252/188.28; 252/390; 252/392; 252/397; 422/16; 422/17

[58] Field of Search ..... 252/188.28, 387, 390, 252/392, 389.61, 389.62, 401, 404; 423/219; 210/699; 422/16, 17

[56] References Cited

U.S. PATENT DOCUMENTS

| | | | |
|---|---|---|---|
| 4,067,690 | 2/1977 | Cuisia et al. | 422/16 |
| 4,269,717 | 10/1980 | Slovinsky | 210/750 |
| 4,278,635 | 12/1979 | Kerst | 252/392 X |
| 4,279,767 | 7/1980 | Muccitelli | 252/392 X |
| 4,282,111 | 4/1980 | Ciuba | 252/393 |
| 4,289,645 | 7/1980 | Muccitelli | 252/188.28 X |
| 4,311,599 | 11/1980 | Slovinsky | 422/16 X |
| 4,350,606 | 10/1980 | Cuisia et al. | 252/392 |
| 4,363,734 | 8/1981 | Slovinsky | 252/188.28 |
| 4,419,327 | 12/1981 | Kelly et al. | 252/188.28 |
| 4,487,708 | 3/1981 | Muccitelli | 252/188.28 |
| 4,540,494 | 3/1983 | Fuchs et al. | 252/188.28 X |
| 4,541,932 | 11/1984 | Muccitelli | 252/188.28 X |
| 4,549,968 | 5/1984 | Muccitelli | 252/188.28 X |
| 4,569,783 | 11/1984 | Muccitelli | 252/188.28 X |
| 4,626,411 | 4/1985 | Nemes et al. | 252/392 X |
| 4,929,364 | 11/1988 | Reardon et al. | 252/188.28 X |
| 4,968,438 | 11/1988 | Soderquist et al. | 252/188.28 X |

OTHER PUBLICATIONS

"The Oxidation and Degradation Products of Volatile Oxygen Scavengers and Their Relevance in Plant Applications", Ellis et al., Corrosion, 87, (Mar. 9-13, 1987), Paper No. 432.

"New Insights into Oxygen Corrosion Control", Reardon, et al., Corrosion, 87, (Mar. 9-13, 1987), Paper No. 438.

"Oxygen Scavengers", Nowak, Corrosion, 89, (Apr. 17-21, 1989), Paper No. 436.

"Characterization of Iron Oxides Films Generated in a New Boiler Feed Water simulator", Batton, et al., Corrosion, 90 (Apr. 23-27, 1990), Paper No. 144.

"Controlling Oxygen in Steam Generating Systems", Jonas, et al., Power, pp. 43-52, (May, 1990).

Literature Search Report, 3/6/90 "Tetramethylphenylenediamine as an Oxygen Scavenger and Reducing Agent".

Literature Search Report, 7/25/90 "Phenylenediamine Derivatives as Oxygen Scavengers".

Denki Kagaku Oyobi Kogyo Butsuri Kagaku, vol. 58, #5, 1990, Kobayashi, et al., "The Electrochemical Behavior of N,N,N',N'-tetramethyl-p-phenylenediamine", abstract only.

Monsanto Product Data Sheet, Santoflex 77, Nov. 1980.

*Primary Examiner*—Deborah L. Kyle
*Assistant Examiner*—Valerie Fee
*Attorney, Agent, or Firm*—Donald G. Epple; Robert A. Miller

[57] ABSTRACT

New oxygen scavengers for boiler waters have been discovered, which oxygen scavengers are based upon N,N,N',N'-tetra substituted phenylenediamines. These compounds provide oxygen scavenging capabilities, metal passivating capabilities, volatility such that condensate systems in an operating boilder are protected, and may be formulated with other oxygen scavengers and other common treatment agents used in boiler waters.

The preferred tetra substituted phenylenediamines are N,N,N', N'-tetramethyl-1,4-phenylenediamines, or its precursors.

9 Claims, 7 Drawing Sheets

Figure 1:
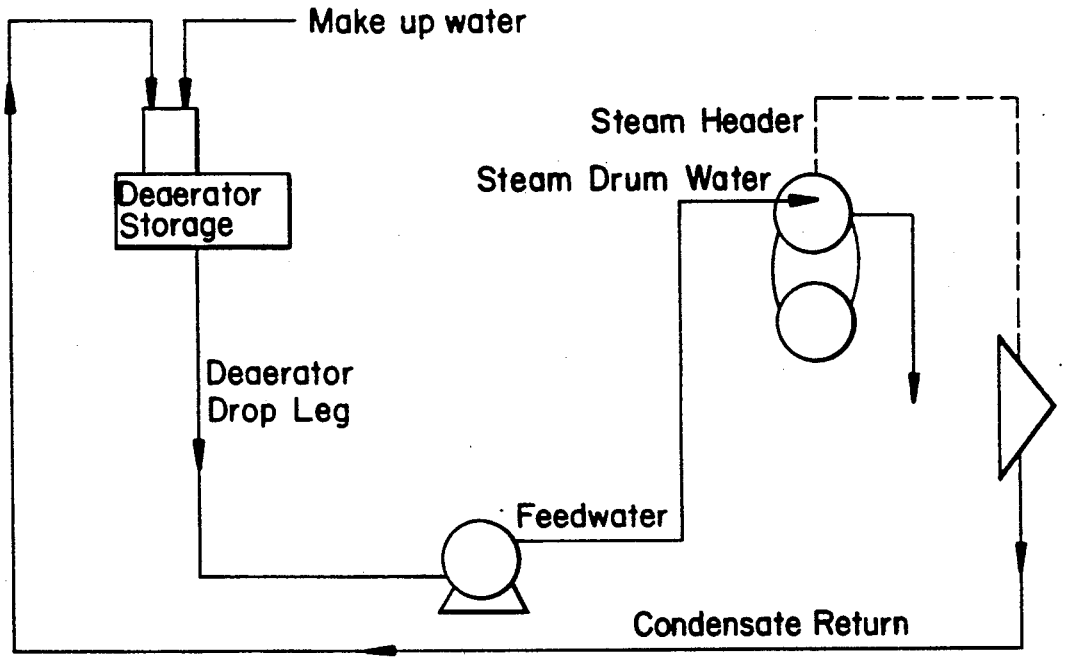

METHOD OF RETARDING CORROSION OF METAL SURFACES IN CONTACT WITH BOILER WATER SYSTEMS WHICH CORROSION IS CAUSED BY DISSOLVED OXYGEN

INTRODUCTION

This invention relates to removing oxygen from boiler waters, thereby protecting metal surfaces in contact with said boiler waters from corrosion caused by the presence of oxygen in these waters.

Additionally, this invention relates to passivation of metal surfaces in contact with boiler waters, which passivation also inhibits corrosion while avoiding scales of such character as to inhibit heat transfer The invention is intended for use in all boiler systems, but is particularly useful in high pressure boiler water systems, for example, those systems operating at a temperature above 250° F., and up to and sometime exceeding 600° F., and at pressures in the range of from about 50 to about 2000 PSIG, or above.

The Oxygen Problem

Dissolved oxygen is objectionable in boiler waters because of the corrosive effect on metals of construction, such as iron and steel in contact with these waters. Oxygen can be removed from these waters by the addition of various chemical reducing agents, known in the art as oxygen scavengers. Various oxygen scavengers have been used in boiler water systems, which oxygen scavengers include sulphite and bisulfite salts, hydrazine, hydroxylamine, carbohydrazides, hydroquinones, hydroquinones in combination with various amines which do not cause precipitation of the hydroquinone, reduced methylene blue, mixtures of hydroxylamine and neutralizing amines, dihydroxy acetones and combinations thereof with hydroquinone and other catalysts, ascorbic acid, and erythorbic acid, particularly as ammonia or amine neutralized salts, catalyzed hydrazines where the catalysts may include complex cobalt salts, other catalyzed hydroquinone compositions, and various combinations of all the above, including but not limited to hydroquinone in combination with various neutralizing amines and in turn combined with erythorbic or ascorbic acid, carbohydrazide; salicylic salicylaldehyde catalyzed hydroquinone, combinations of N,N dialkyl substituted hydroxylamines with or without hydroquinones, dihydroxybenzenes, diaminobenzenes, or aminohydroxybenzene, optionally in the presence of neutralizing amines, and various amine combinations with gallic acid blends.

These oxygen scavengers are taught in the following U.S. Pat. Nos.;

U.S. Pat. No. 4,067,690, Cuisia, et al.
U.S. Pat. No. 4,269,717, Slovinsky
U.S. Pat. No. 4,268,635, Curst,
U.S. Pat. No. 4,279,767, Muccitelli
U.S. Pat. No. 4,282,111, Ciuba
U.S. Pat. No. 4,289,645, Muccitelli
U.S. Pat. No. 4,311,599, Slovinsky
U.S. Pat. No. 4,350,606, Cuisia, et al.
U.S. Pat. No. 4,363,734, Slovinsky
U.S. Pat. No. 4,419,327, Kelly, et al.
U.S. Pat. No. 4,487,708, Muccitelli
U.S. Pat. No. 4,540,494, Fuchs, et al.
U.S. Pat. No. 4,541,932, Muccitelli
U.S. Pat. No. 4,549,968, Muccitelli U.S. Pat. No. 4,569,783, Muccitelli
U.S. Pat. No. 4,626,411, Nemes, et al
U.S. Pat. No. 4,929,364, Reardon, et al
U.S. Pat. No. 4,968,438, Soderquist, et al.

Each of these patents is incorporated herein by reference.

In addition, the general concepts involved in controlling oxygen corrosion by eliminating oxygen and passivating metal surfaces in contact with boiler waters have been reviewed in the following papers, 1. "The Oxidation and Degradation Products of Volatile Oxygen Scavengers and Their Relevance in Plant Applications" Ellis, et al, Corrosion, 87, (Mar. 9-13, 1987), Paper No. 432.
2. "New Insights into Oxygen Corrosion Control", Reardon, et al, Corrosion, 87, (Mar. 9-13, 1987), Paper No. 438.
3. "Oxygen Scavengers", Nowak, Corrosion, 89, (Apr. 7-21, 1989), paper No. 436.
4. "Characterization of Iron Oxides Films Generated in a New Boiler Feed Water Simulator", Batton, et al, Corrosion, 90, (Apr. 23-27, 1990), Paper No. 144.
5. "Controlling Oxygen in Steam Generating Systems", Jonas, et al, Power, Page 43-52, (May, 1990).

The above summaries, U.S. patents and literature are believed to give and provide a relatively complete background in regards to the use of oxygen scavengers of various types in boiler waters and the benefits of accomplishing the removal of oxygen from these boiler waters.

In spite of the extensive art regarding oxygen scavenging from boiler waters, there are certain limitations in the technology being practiced which limitations are primarily involved with passivation of the metal surfaces and the formation of oxygen scavenging species which are sufficiently active in boiler waters and yet sufficiently volatile so as to at least proportionately accumulate in sufficient concentration in the condensate systems, thereby not only protecting the boiler metal surfaces but also the condensate system metal surfaces from corrosion caused by the presence of oxygen.

It would therefore be an advance in the art to provide an oxygen scavenger which would passivate metal surfaces in contact with boiler waters which metal surfaces include those metal surfaces involved with heat transfer and formation of steam and also those metal surfaces in contact with steam and condensates derived from generated steams and condensed steams in the condensate system and return condensate water systems of an operating boiler. It would also be of benefit to have an oxygen scavenger that could be an amine or amino compound having sufficient basicity to neutralize any extemporaneous acidity in overhead condensate system. This extemporaneous acidity is often caused by generation of carbon dioxide either as air leakage into the condensate system or possibly even from breakdown of organic materials inadvertently or purposely added to boiler waters.

THE INVENTION

We have found a chemical system which has superior oxygen scavenging capabilities, and which enhances passivation of metal surfaces in contact with boiler waters, and has a volatility ratio, in at least one active form of the molecules involved, which can provide both oxygen scavenging capabilities in the condensate system as well as neutralizing and corrosion inhibiting activity in this condensate system. This chemistry is based upon N,N,N',N'-tetrasubstituted phenylenediamines. Our invention is a method of scavenging oxygen from boiler waters and passivating metal surfaces in contact with said waters comprising treating the boiler waters with an effective oxygen scavenging amount of a compound, or mixtures of compounds having the structure:

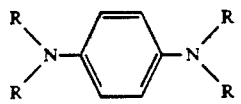

It is important to have components in our treating and oxygen scavenging agents, which are tetrasubstituted as above, although the substitution on the diaminophenylene compounds may also be less than tetrasubstituted. The amino groups of the phenylendiamine structures must contain at least one substituent, preferably at least two substituents, and most preferably both amino groups are bi-substituted, so that the N,N,N',N' phenylendiamine tetrasubstituent moieties are active ingredients of our formulations. Substituents, on either or both amino groups, are preferably chosen from the group consisting of lower linear and branched alkyl groups having from 1–4 carbon atoms and carboxylated groups having the structure:

$$\text{-}(CH_2)_n\text{-}COOM$$

wherein n ranges from 1–3, M is chosen from the group consisting of hydrogen, alkaline metal cations, alkaline earth metal cations, ammonium cations, or any acidified amino or quaternary amino cation, or mixtures thereof. In addition, the N,N,N',N' tetrasubstituents may be chosen from mixtures of the linear and branched alkyl groups described and the carboxylated groups described above.

To better define our chemical structures and the use of these chemical structures for scavenging oxygen from boiler waters, the following formulas are presented:

The preferred active oxygen scavengers have structures set forth in Formula I

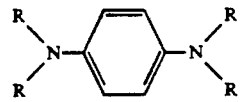

Wherein R is chosen independently, at each occurrence, from the group consisting of linear or branched alkyl groups containing from 1–4 carbon atoms, carboxylated alkyl groups having from 1–4 carbon atoms and represented by the structure:

$$\text{-}(CH_2)_n\text{-}\overset{O}{\overset{\|}{C}}OM$$

wherein n ranges from 1 to 3, and M is hydrogen, alkali metal cations, alkaline earth metals, ammonium cations, acidified or quaternized amino cations, mixtures thereof; and equivalent cationic species present in electroneutralizing amounts.

To further exemplify specific and preferred chemical structures, the following chemical formulas are present, each formula following within the scope of our invention, and the invention also including any admixture of these chemicals. The following table is not meant to be limiting, but merely is exemplary of formulas, or combinations thereof, which are useful in this invention.

Specific example of the oxygen scavengers of this invention.

1. 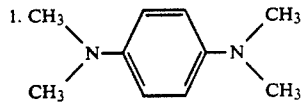

2. 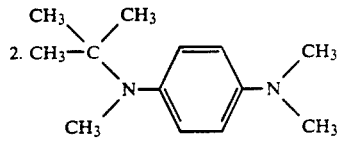

3. 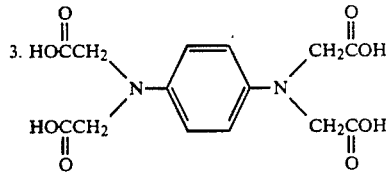

4. 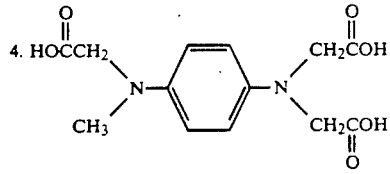

5. 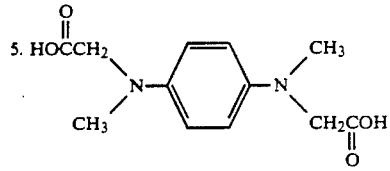

6. 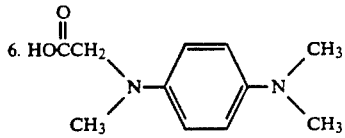

7. 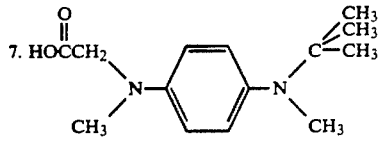

8. 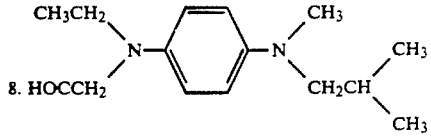

-continued

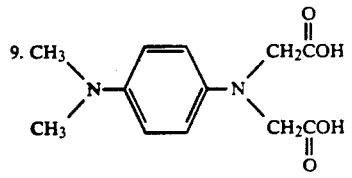

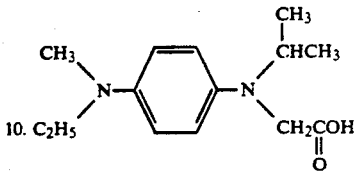

In addition to containing at least one type of the above molecules, our oxygen scavenging formulations may be formulated in pure form, in mixtures with other active molecules of the same substituted phenylenediamine family, and/or in mixtures with other ingredients normally used in boiler water treatment.

Preferred Admixtures

Since the materials involved ,are such good oxygen scavengers, formulations which contain the materials often have to be protected against degradation in contact with air. To do this, these formulations are typically made in admixtures with other anti-oxidants. Such anti-oxidants include, but are not necessarily limited to various sulphite or bisulfite salts, ascorbic acid or erythorbic acid or their water soluble salts, diethylhydroxylamine, hydrazine, 1,3-dihydroxyacetone, gallic acids or its salts, hydroquinone, carbohydrazide, 2-ketogluconate, unsubstituted diaminobenzenes, hydroxyaminobenzenes, and the like. Additionally, these known oxygen scavengers could be advantageously admixed with the volatile oxygen scavengers of this invention to obtain advantageous formulations that would be stable for use in boiler water treatment, and provide improved metal passivation and overhead condensate system corrosion controls.

Other complexing agents may be admixed either to provide stability in a boiler or to provide protection of these formulations against contact with hardness ions and the like. The complexing agents can include, but are not necessarily limited to, ethylenediaminetetraacetic acid, nitrilotriacetic acid, and such other low molecular weight carboxylate acids, such as citric acid, acetic acid, propionic acid, maleic acid, malic acid, and the like, or their salts.

In addition, these materials may be formed and formulated in the presence of polymers that are water soluble, which polymers would normally be used to treat boiler waters. These polymers normally contain carboxylate containing monomers, and the polymers are water soluble. The polymers include homopolymers and copolymers of acrylic acid, methacrylic acid, maleic acid, maleic anhydride, itaconic acid, and the like. When these polymers are copolymeric in nature, the other monomer units may be chosen from at least one of the group consisting of acrylamide, methylacrylamide, acrylic acid, methacrylic acid, maleic acid, or anhydride, and the like. Polymers and copolymers of acrylic acid and methylacrylic acid and other carboxylated polymers may also contain at least one of the sulfonated monomer species such as, but not limited to, vinyl sulfonate and N-substituted sulfonic acid acrylamides, sulfonated styrenes, and the like.

Finally, these oxygen scavenging formulations may contain inorganic acids, other organic acids and buffering agents, amino acids, orthophosphate ion sources or other precipitating anion sources, organic phosphonate compounds, and the like.

Even though the oxygen scavenging formulation itself may not contain these materials, the boiler waters being treated may still be additionally treated with at least one or combinations of these other ingredients such that the boiler water itself may contain any one or any combination of any of these materials as outlined above.

Boiler water

When we use the term boiler waters, we are primarily describing any water source that is external or internal to an operating industrial steam generating system, particularly boiler systems that are operating at pressures ranging from 50 PSIG up to and including 2,000 PSIG, and above. These boiler waters can include, but again are not necessarily limited to, deaerator drop-leg waters, boiler feed waters, internal boiler waters, boiler condensate waters, any combination thereof and the like. The boiler waters are normally treated by simply adding to the water to be treated a formulation, which formulation contains an effective oxygen scavenging amount of at least one of our compounds, as described above, and which may also contain other anti-oxidants, polymers, acid and/or base neutralizing agents, sequestering and/or chelating agents, also as described above.

Admixtures With Other volatile or Neutralizing Amines

In addition to the admixtures mentioned above, the diaminophenylene compounds, particularly those which contain carboxylate structures in free acid form. may be formulated with various ammonia or amine compounds where the amines may be any organic amines, but particularly are those organic amines chosen from the group consisting of hydroxylamines having the structure:

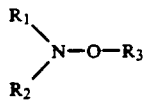

Where R1, R2, and R3 are either the same or different and are selected from the group consisting of hydrogen, lower alkyl, and aryl groups, water soluble salts of these compounds, and the like. Suitable hydroxylamine compounds include hydroxylamine; N,N-diethylhydroxylamine; hydroxylamine hydrochloride; hydroxylammonium acid sulfate, hydroxylamine phosphate, N-ethylhydroxylamine; N,N-dimethylhydroxylamine, O-methylhydroxylamine, N-hexylhydroxylamine; O-hexylhydroxylamine; N-heptylhydroxylamine; N,N-dipropylhydroxylamine and like compounds.

Other suitable neutralizing amines include morpholine, cyclohexylamine, diethylaminoethanol, dimethyl-(iso)-propanolamine; 2-amino-2-methyl-1-propanol;-dimethylpropylamine;benzylamine,1,2-propanediamine; 1,3-propanediamine; ethylenediamine; 3-methoxypropylamine; triethylenetetramine; diisopropanolamine; dimethylaminopropylamine; monoethanolamine;

secondary butylamine; tert-butylamine; monoisopropanolamine; hexamethylenediamine; triethylenediamine and the like. Other neutralizing amines are well known in boiler water treatment.

Since the active oxygen reactive compound may also be an amine structure in at least one of its forms, it is feasible to formulate the N,N,N',N'-tetraalkyl substituted phenylenediamines with other oxygen active phenylenediamine structures that are in a carboxylate containing form. This combination of a carboxylated active form with an amine active form of our oxygen scavengers may also provide improved water soluble materials for use in our formulations. Although water solubility is not a requirement, it can be beneficial in formulating final products for use in the boiler waters. Such products, however, may also be stabilized by the addition of various cosolvents, solubilizing or dispersing adjuncts, emulsifiers, water soluble or dispersible polymers, inorganic or organic salts, and the like.

Application and Use

Use of our substituted N,N,N',N' substituted phenylenediamines are preferably made in boiler feed water, or in the deaerator drop-leg waters so that the oxygen scavenger is useful in removing trace oxygen amounts prior to the water entering the operating boiler. When these formulations are used in the feedwater or the deaerator drop-leg waters, the formulations may contain carboxylate functionality, as indicated above, or they may contain free amine functionality, as indicated above, or they may contain mixtures thereof, either on the same molecule, or formed as salts of different molecules. They may also be formed in admixture one with the other, either by themselves or in the presence of other solubilizing or dispersing materials, neutralizing materials, complexing materials, polymeric materials, and the like, or with other anti-oxidants, such as erythorbic acid.

The formulations normally contain anywhere from 0.1 up to about 10 weight percent (or above) active oxygen scavenging component, and these formulations are added in effective oxygen scavenging amounts to the boiler waters, (see FIG. 1) preferably boiler feed water, the deaerator storage or the deaerator drop-leg waters, condensate return waters, internal steam drum boiler waters, condensate waters, steam header waters or the like. Effective concentrations in boiler waters can range from about 10 parts per billion up to and including 50 ppm, or above. FIG. 1 sets forth a general outline of a boiler and some locations of various boiler waters which may be treated with our oxygen scavengers.

If our compounds are going to be used primarily in the condensate system, they are preferably added as the free amine compounds since substitution by carboxylate functionality could contribute to corrosion in the condensate system, but this potential corrosion can be controlled when formulated with neutralizing compounds, such as the neutralizing amines. The carboxylate compounds may be used in the condensate system if they are used with the above amine neutralizers or the fully substituted tetraalkyl phenylenediamines of this invention.

To better describe our invention, the following examples are provided:

EXAMPLES

In providing these examples, we identify a chemical compound or family of chemical compounds which are highly reactive with oxygen, and which are volatile such that a high vapor/liquid, or V/L, ratio is obtained when these formulations are fed to an operating boiler. These compounds provide no contribution to dissolved solids in high pressure boiler systems operating at temperatures ranging from 250° F. to about 900° F. or above. The formulations containing these materials may be used with current internal boiler water treatment programs such as those programs including polymers, both the so-called all polymer treatments as well as dispersant polymers in combination with precipitating agents like phosphate or carbonate anions, other oxygen scavengers such as hydroquinone, erythorbic acid, carbohydrazide and the like, and other known and similar treatment agents for boiler waters.

In addition, these compounds have low toxicity, can be easily formulated in aqueous based solutions, either soluble or dispersed as need be, and are cost effective. Finally, these materials are easily monitored because the reaction of certain oxidizing agents, i.e. $K_3Fe(CN)_6$ with these materials form a relatively stable free radical species, which is deeply blue colored and can easily be detected at concentrations of one part per million or below.

Our compounds, particularly, N,N,N',N'-tetramethyl-1,4-phenylenediamine (TMPD) have been demonstrated to scavenge oxygen stoichiometrically at approximate mole ratios of 1:1 or above, at both ambient temperatures and at temperatures of 300° F. and above. This performance, with respect to its oxygen scavenging ability, is similar to hydroquinone formulations.

This TMPD compound is highly volatile and is demonstrated to have a vapor/liquid distribution ratio similar to diethylhydroxylamine. This V/L ratio is demonstrated to be in the 2–8 V/L ratio range.

These materials, or their carboxylated precursors, such as 1,4-phenylene diamine -N,N,N$\alpha$,N',-tetraacetic acid, hereinafter PDTA, can be easily fed to boiler waters, provide oxygen scavenging capability, not only in the boiler feed water, but also in the operating boiler waters, and because of its volatility in the boiler condensate systems as well. When only the carboxylate forms of our structures are added to boiler feed water, the materials have been demonstrated to decarboxylate in the environment of an operating boiler system to form the substituted amine compounds, which then are delivered to the condensate system thereby providing neutralization, oxygen scavenging, corrosion, and scale control. After decarboxylation of the starting materials, the fully alkylated materials exhibit such high volatility that their contribution to dissolved solids in boiler blowdown is essentially negligible.

In addition, the experiments presented demonstrate, via electro chemical information, that these compounds also provide for improved metal passivation of boiler surfaces in contact with boiler waters containing these materials.

A most preferred material, TMPD, has toxicity that is less than hydroquinone, considerably less than unsubstituted phenylene diamines and would be anticipated to be safer in use than formulations containing either of the above.

Analytical procedures may be utilized to measure chemical oxidation of our compounds and are simply followed by the measurement, by UV-visible spectroscopy, at wavelengths designed to monitor free radicals generated by the oxygen reaction with TMPD, or its precursors, PDTA, admixtures thereof, or other similar N,N,N'N'-1, 4-phenylenediamine substituted compounds.

Experiments demonstrating electrochemical passivation are employed as follows:

High Temperature Passivation Characteristics

1. Using techniques described in a Nalco Chemical Company reprint 522, tubular mild steel samples, prepared in the usual manner, were conditioned for a period of three days under blank conditions, then three days treatment using our substituted phenylenediamines at concentrations equivalent to 100 parts per billion, calculated as hydrazine. At the end of the three day treatment test, these mild steel tubes were removed and subjected to linear polarization using the electrochemical cell as set forth in FIG. 2.

2. The results of these tests are set forth in FIG. 3, entitled "Polarization Resistance Comparison of Oxygen Scavengers, Versus No Treatment". In this FIG. 3, polarization resistance of TMPD and PDTA are compared to $R_P$ of hydrazine and carbohydrazide, as well as no treatment. The results indicated that our oxygen scavengers are metal passivators, particularly as temperature increases, and that they passivate at least as well as known passivators such as carbohydrazide. Similar tests with diethylhydroxylamine and hydroquinone demonstrate that these oxygen scavengers provide no passivation beyond that observed under blank conditions.

3. The technique in the above referenced Nalco reprint 522, prepares a tubular mild steel sample by conditioning it for 3 days in an aqueous caustic solution at pH=9.0. This aqueous medium is initially anaerobic (i.e. less than 2 ppb oxygen) and is maintained at less than 5 ppb oxygen during the conditioning period. After conditioning, this tubular sample is exposed an additional 3 days to the same pH 9 caustic solution, now containing the oxygen scavenger/passivative treatment agent.

4. After this second three day period, linear polarization measurements are performed and analyzed to produce the results described above. In the tests for PDTA, tubes without heat flux show a lower polarization resistance than the tubes with heat flux. Visually, however, both tubes, treated with the different form of oxygen scavenger, had an adherent dark brown to blue surface with no evidence of pitting. Linear polarization is an electrochemical technique providing for the imposition of known potentials, which potentials are ±10 millivolts on either side of the $E_{corr}$ (the open circuit potential of the test electrode material, that is the corrosion potential). $E_{corr}$ is defined as the potential at which the rate of reduction is equal to the rate of oxidation. The measurement of generated currents and the determination of the polarization resistance, $R_p$, which determination is based upon the slope measurements of the current versus potential scans available under the test conditions, are used to analyze the effect and the presence of passive layers formed during the conditioning tests outlined above.

Figure 2:
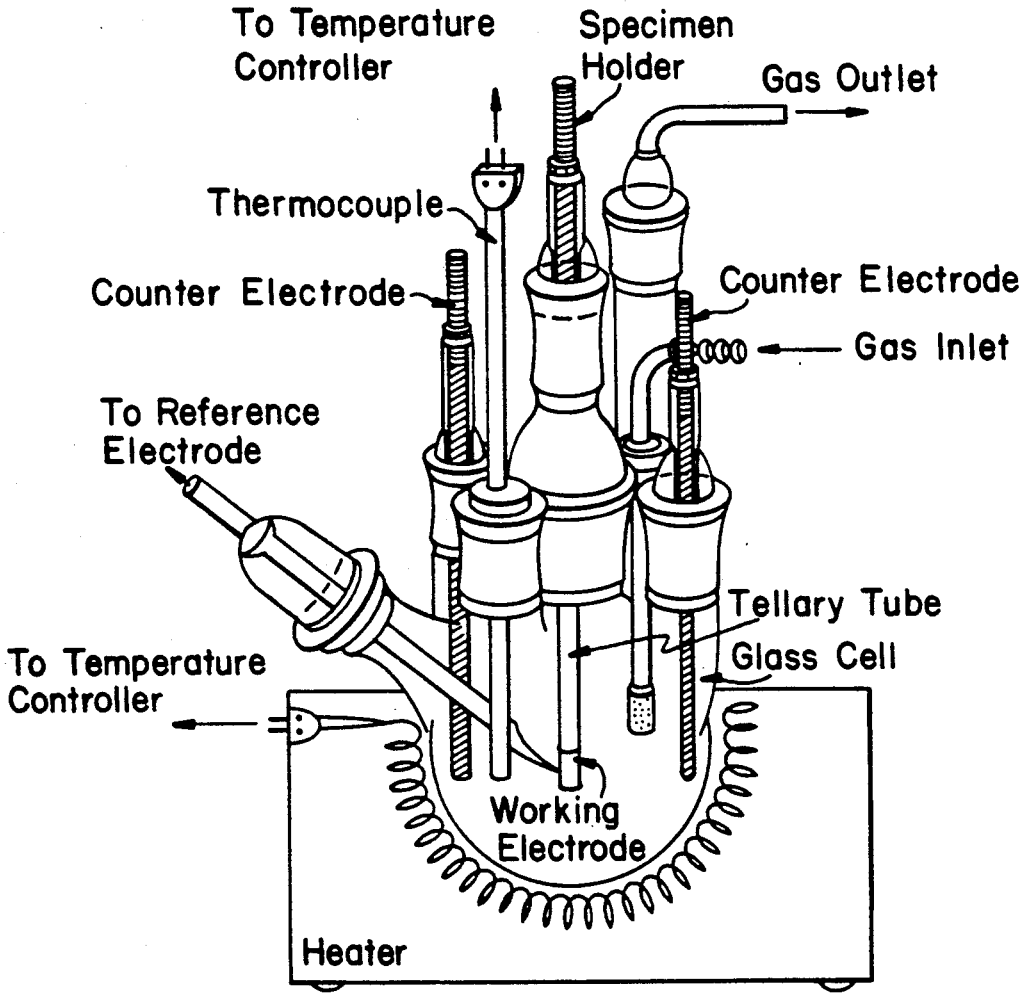
Figure 3:
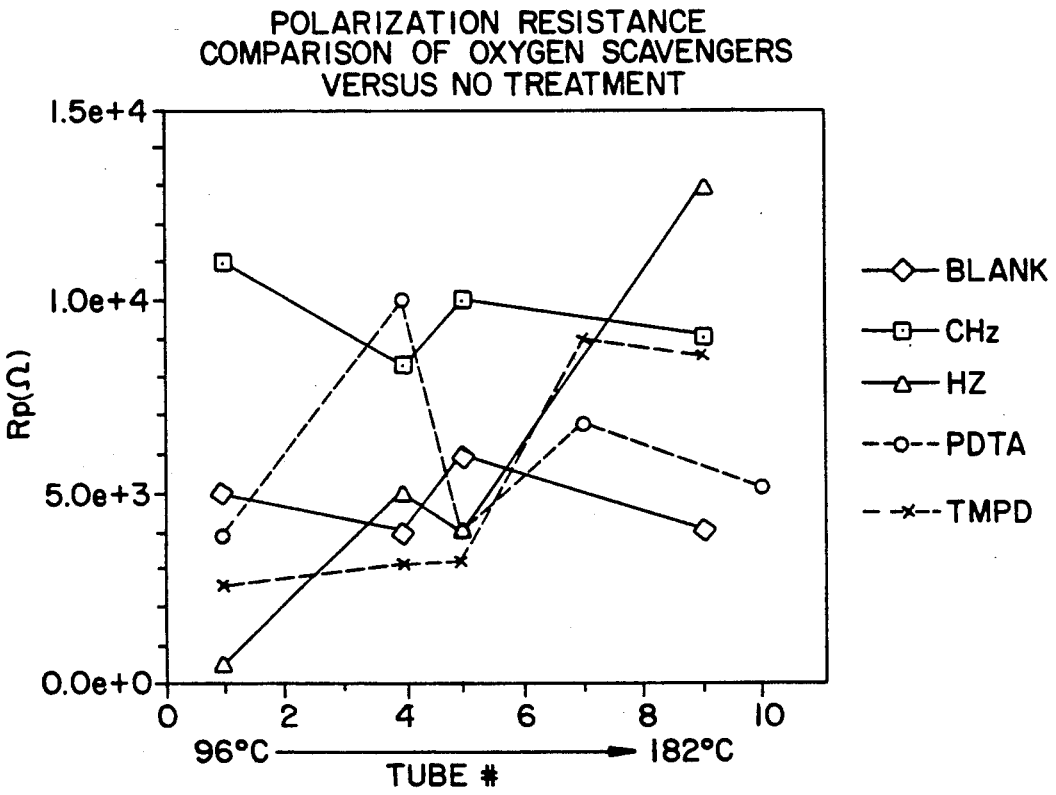

These results are then interpreted to measure the ability of our oxygen scavengers, as well as other oxygen scavengers to passivate the metal surfaces. These electrochemical procedures, in addition to the results outlined above in FIG. 3, are set forth in the examples below: All of these methods used mild steel tubular AISI1008 test specimens which were prepared by polishing with silica carbide sand paper successfully through Grits no. 120, no. 240, no. 400, and no. 600. After the dry polishing, the specimens are rinsed in acetone, dried, and installed in the electrochemical test cell. In the electrochemical test cell, the specimens are rotated in the test solutions at 500 rpm using a Pine rotater model AFMSRX, in 800 milliliters of a perchlorate solution contained in a Princeton corrosion cell as shown in FIG. 2. Typical procedures were to prepare a 0.1 molar solution of sodium perchlorate by adding 9.8 grams of sodium perchlorate to 800 milliters of double deionized water and deaerating with zero grade argon by purging for at least 30 minutes. The temperature is subsequently raised to 80° C.

After this solution is prepared, aproximately 45 micromolar solutions of TMPD were prepared by adding 6.0 milligrams of TMPD to the deareated solution contained in the corrosion cell. The pH was adjusted to 9.0 at 25° C. by the addition of caustic as required. The temperature was raised to 80° C. and the mild steel sample on the rotator was lowered into the electrochemical test cell and polarization resistant measurements, as described above, where taken over a period of 24 hours.

Figure 4:
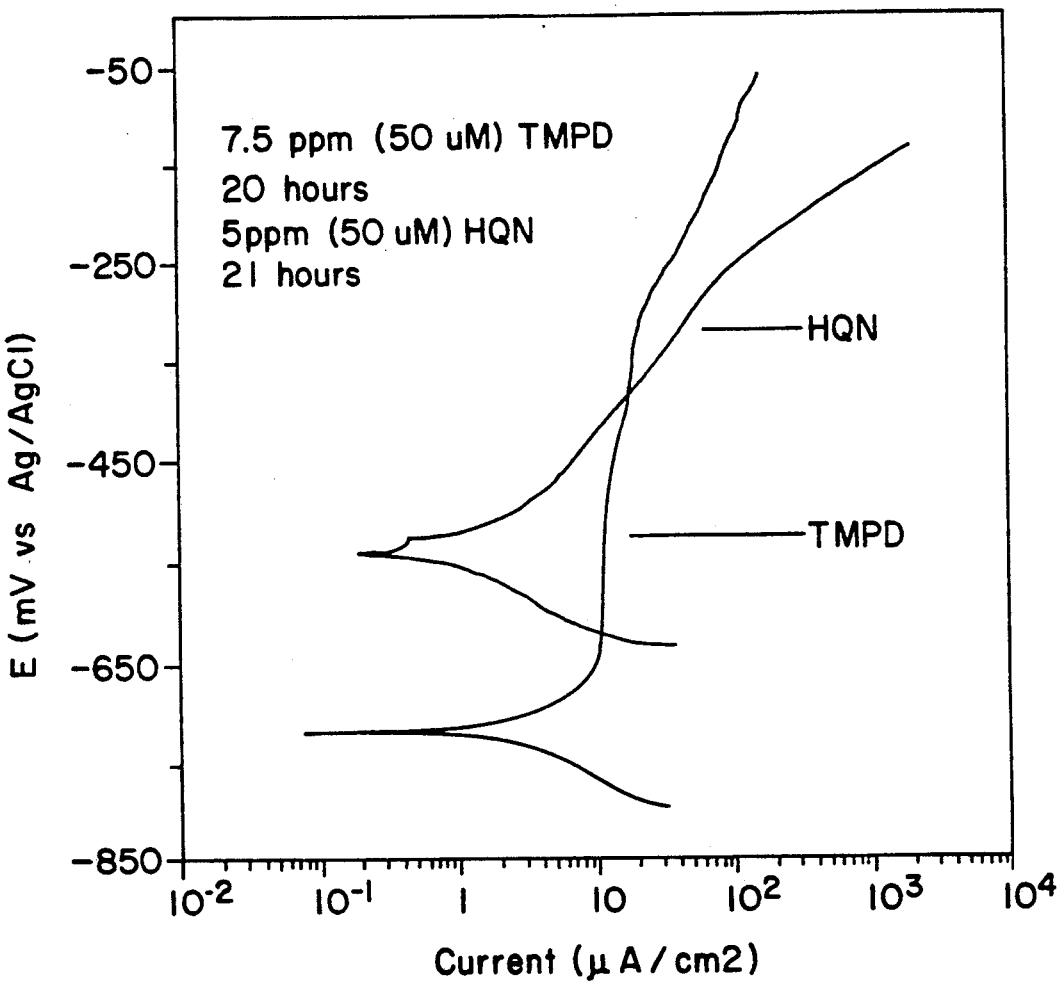

FIG. 4 presents the potentiodynamic scans for both TMPD and hydroquinone. After approximately 20 hours, the results of this test sequence indicates that TMPD is a better passivator than is hydroquinone.

Figure 5:
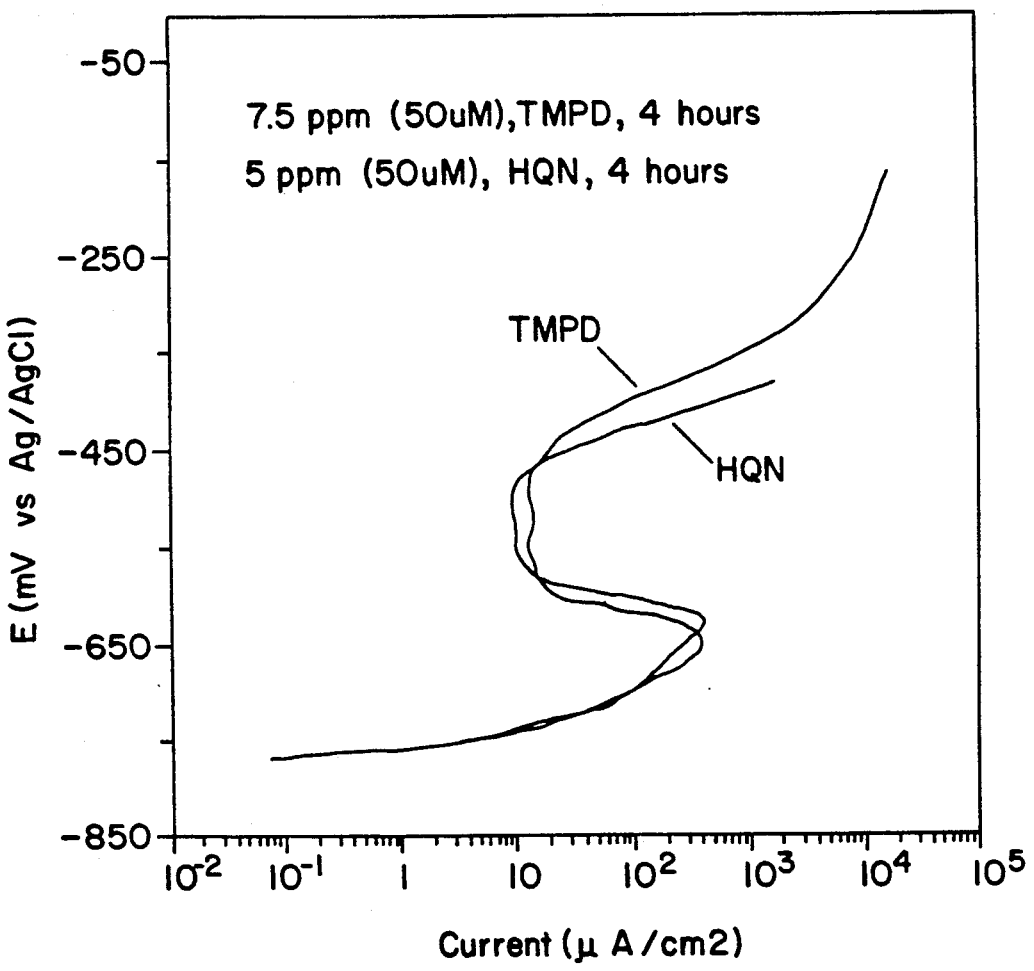

FIG. 5, also demonstrates the same results for TMPD and hydroquinone, but these results are after a passage of time of only four hours. Even these results for a four hour test period show that metal oxide passivation layers formed with TMPD are greatly improved over those metal oxide layers formed with hydroquinone. The hydroquinone anodic currents are increasing at a faster rate and become much higher than those obtained with TMPD.

Analysis of Electrochemical Data

TMPD shows a greater stability of the oxide layers than those oxide layers formed using hydroquinone. At higher potentials, hydroquinone has much higher anodic currents than does TMPD.

It is believed that the oxide layer formed when using TMPD is more stable than that layer formed when using hydroquinone, as indicated by the shape of the potential/current scan region in the anodic potentiodynamic scans.

EXAMPLE 2

Figure 6:
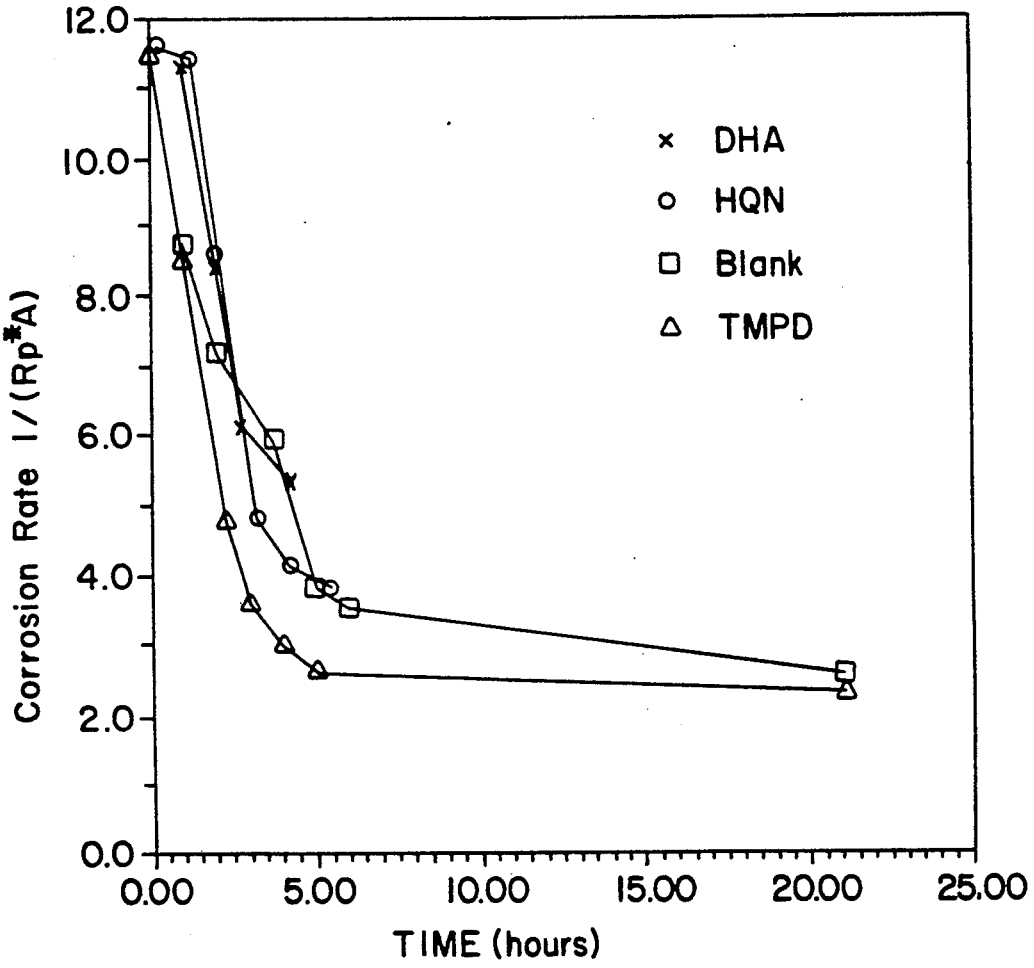

In a modification of the previously described method, again based on electrochemical analysis, a comparison of corrosion rates in the presence of various oxygen scavengers was completed. The use of linear polarization to determine the progression of corrosion rates in long term tests was difficult because of the large changes in polarization resistance caused by many small upsets, such as oxygen ingress, to our system. However, it is found that polarization resistance of mild steels reach equilibrium after approximately 24 hours. FIG. 6 shows the corrosion rate verses time data comparing TMPD, a blank, hydroquinone, and dihydroxyacetone, (DHA), another known oxygen scavenger. TMPD shows slightly lower corrosion rate at 24 hours than the other scavengers tested.

Vapor/Liquid volatility Ratio

Volatility of the chemical, TMPD, was found to be high, in the range of 4–8 V/L ratio, see Table I. This volatility is comparable to the volatility observed for diethylhydroxyalamine, a known volatile compound used as an oxygen scavengers in boiler systems. However, tests with unsubstituted 1,4-phenylenediamine indicates a V/L ratio below 0.2 as measured by scale boiler tests. Therefore, without the N,N,N',N' substitution, this molecule cannot provide protection to the condensate system. Volatility was determined by scale boiler tests. Boiler feed water, i.e. FW, was made up with caustic (NaOH) to a pH of 10, and NaCl at 20 ppm. The pH of the blowdown waters, i.e. B.D., would then be 11 with 200–400 ppm Na. TMPD concentration was determined by an analytical method described below for the BD, FW, and condensate waters. Volatility ratios are determined from these measurements.

The analytical method of analyzing for TMPD in solution utilized the complete chemical oxidation of this molecule to form an intensely blue stable free radical called "Wurster's blue". The UV-visible spectra for this blue free radical in solution demonstrates an absorbence maximum at 610 nm. PDTA, on the other hand also forms a free radical and this radical is stabilized by the presence of the carboxyl group which red shifts the adsorption band maximum from 610 nm to 643 nm. When both chemicals are present in solution, the relative concentrations of both TMPD and PDTA are determined by solving simultaneous equations of a known general form. Although this oxidation can be done by exposing the solutions with air and oxygen, it is preferred to perform this oxidation with potassium ferricyanide generating a Beer's law curve using standard materials and comparing the results of test materials to this Beer's law curve. Although analytical results can be generated in the presence of both TMPD and PDTA by using the simultanoues equation approach mentioned above, which approach is known in the art, if only one species is present, this simultaneous equation approach obviously would not be necessary.

Scale Boiler Tests

Conditions for oxygen scavenging boiler tests were identical to those used for the determination of V/L ratios elsewhere. In the first series of tests, PDTA was fed into the test boiler system at approximately 5 parts per million, based on total water feed. Scale boiler tests were used to test both the decarboxylation of PDTA to TMPD in an operating boiler environment and also to measure the V/L ratio of TMPD. In at least one test, the scale boiler was operated in the presence of hardness.

In all of these tests, the vapor/liquid ratio range from 4 to 6 and sometime as high as 8. However, the unusually high values were attributed to difficulties in determining blowdown concentration of TMPD in our initial test sequence.

Both PDTA and TMPD were tested alone and in the presence of water soluble polymers containing acrylic acid and acrylamide. These tests were done in the presence of 1.5 parts per million total hardness, as calcium carbonate and a polymer to hardness ratio ranging from about 4.4:1 to about 12:1. The boiler operating pressures ranged from 600 to about 1500 PSIG. The presence of these oxygen scavengers did not, within experimental error, affect the polymer's abilities to sequester and transport calcium, magnesium, $SiO_2$, and the like across the boiler. Therefore, it is anticipated that these oxygen scavengers are useful in combinations with these polymer based boiler water treatments. TMPD was also tested with boiler water treatments including the so called coordinated phosphate and residual phosphate programs with no detrimental effects being noted.

Continued Scale Boiler Testing

Scale boiler tests also were performed which demonstrate that PDTA, for example, does, in fact, decarboxylate to form TMPD in boiler waters in an operating boiler. This TMPD is then volatilized into the steam and can act as an oxygen scavenger neutralizing amine, corrosion and scale inhibitor in the boiler condensate system. Although some difficulty was encountered in measuring the presence of TMPD in the boiler blowdown, after the analytical procedures had been refined, it was demonstrated that the deaerator drop-leg, contained only PDTA when this material was fed to the boiler, the blowdown had a mixture PDTA and TMPD present, and the condensate system waters contained only TMPD. All of these materials, or mixtures of any of these materials are active in the instant invention.

Oxygen Scavenging Capacity

TMPD was tested on both bench-top oxygen scavenging testing unit and on the Field Temperature Simulator, or the "FTS" unit for oxygen scavenging ability. At 185° F., (Bench-Top) TMPD fed at 2:1 molar ratio to oxygen lowered the oxygen level in test waters from concentrations of 8.33 parts per million to 4.3 parts per million. Increasing the molar ratio to 4:1 resulted in no essential improvement. Most likely this is due to the lack of solubility of TMPD in the boiler waters. However, under boiler operating conditions, oxygen concentrations are normally less than 100 parts per billion, and in these cases, TMPD has sufficient solubility to react stoichiometrically with the oxygen present.

FTS Testing

Figure 7:
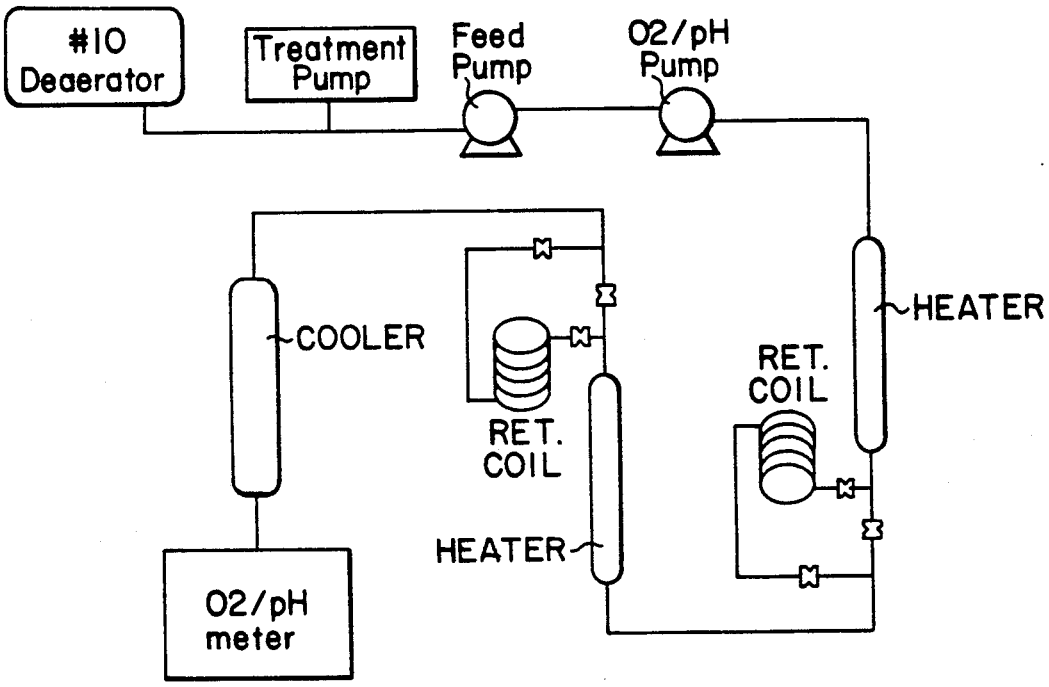

Testing in the FTS unit, which is diagrammed in FIG. 7, determined that TMPD can react with oxygen substoichiometrically with an approximate molar ratio of 1:1 when the unreacted TMPD is taken into count. This exceeds the theoretical number of electrons required to reduce oxygen from a simple oxidation of TMPD, but it is possible that the imine radical which is formed, and yields intense blue colors, may also further react with oxygen, thereby yielding additional electrons available for this oxygen reduction reaction. Data obtained on the FTS unit indicates a significant residual is available for further oxygen reduction when the retention time is increased. At a 1.55:1 dosage of TMPD to oxygen, removal of oxygen increases from 45% with a three minute retention to 60% with a 12.5 minute retention time. Table III presents the data described above.

TABLE III

Field Temperature Simulator for Oxygen Scavenger Screening
Conditions: Flow = 60 ml/min, retention time 2.94, 7.72, 12.5 min.
Temp.(°F.): 300° F.
pH controlled by addition of NaOH reagent (0.8 g of 50% NaOH/2 liter D.I. water)

| Moles Scav fed (theo.) | ppm Scav fed (theo.) | pH final | % O2 removed | Residual ppm Scav | Scav Inlet ppm | Retention Time minutes |
|---|---|---|---|---|---|---|
| | | | TMPD | | | |
| 0.78:1 | 0.44 | 9.5 | 43 | na | na | 7.72 |
| 1.17:1 | 0.66 | 9 | 54 | 0.44 | 0.6 | 7.72 |
| 1.55:1 | 0.88 | 9.8 | 65 | 0.85 | 1.08 | 7.72 |
| 1.55:1 | 0.88 | 9.6 | 63 | 0.66 | 0.86 | 7.72 |
| 1.55:1 | 0.88 | 9.4 | 65 | na | na | 12.5 |
| 1.55:1 | 0.88 | 9.4 | 52 | na | na | 7.72 |
| 1.55:1 | 0.88 | 9.4 | 40 | na | na | 2.94 |
| 2.00:1 | 1.13 | 9.6 | 58 | 0.6 | 1.15 | 12.5 |
| 2.00:1 | 1.13 | 6.5 | 72 | 1.14 | 1.24 | 12.5 |
| 4.00:1 | 2.26 | 9.3 | 76 | 1.84 | 2.46 | 12.5 |
| 2.00:1 | 1.13 | 9.4 | 56 | 0.99 | 1.1 | 12.5 |
| | | | PDTA | | | |
| 0.78:1 | 0.91 | 9.5 | 65 | 0 | 1.05 | 12.5 |
| 1.17:1 | 1.37 | 9.2 | 80 | 0.11 | 1.55 | 12.5 |
| 1.55:1 | 1.82 | 9.4 | 89 | 0.19 | 2.18 | 12.5 |
| | | | SYNTHESIZED PDTA | | | |
| 0.78:1 | 0.91 | 9.2 | 70 | 0 | 0.57 | 12.5 |
| 0.78:1 | 0.91 | 9.3 | 73 | 0 | 0.43 | 12.5 |
| 1.17:1 | 1.37 | 9.3 | 85 | 0 | 0.79 | 12.5 |
| 1.55:1 | 1.82 | 9.55 | 94 | na | na | 12.5 |
| 1.55:1 | 1.82 | 9.55 | 91 | 0.05 | 0.98 | 12.5 |
| 1.55:1 | 1.82 | 9.55 | 87 | 0.11 | 1.09 | 7.72 |
| 1.55:1 | 1.82 | 9.55 | 81 | na | na | 2.94 |
| 0.78:1 | 0.91 | 9.45 | 35 | 0 | 0.51 | 2.94 |
| 0.78:1 | 0.91 | 9.45 | 42 | 0 | 0.48 | 7.72 |
| 0.78:1 | 0.91 | 9.45 | 47 | 0 | 0.51 | 12.5 |

na = not available

TABLE 1

Scale Boiler testing of TMPD/PDTA effect on internal treatment programs

| Test No. | Reductant (ppm) | Internal Treatment | Psig | Polymer Dosage ppm Treat./'H' | ppm 'H' | V/L ratio | % Ca | % Mg | % Polymer 1 | % $SIO_2$ |
|---|---|---|---|---|---|---|---|---|---|---|
| 1 | 5 PDTA | None | 1000 | | 1.5 | 5.0 ± 2.6 | | | | |
| 2 | 5 PDTA | None | 600 | | | 4.0 ± 2.9 | | | | |
| 2 | 5 PDTA | None | 1000 | | | 8.0 ± 6.0 | | | | |
| 2 | 5 PDTA | None | 1500 | | | 5.1 ± 0.0 | | | | |
| 3 | 5 PDTA | None | 600 | | | 7.9 ± 1.2 | | | | |
| 3 | 5 PDTA | None | 1000 | | | 8.2 ± 1.9 | | | | |
| 3 | 5 PDTA | None | 1500 | | | 6.7 ± 0.8 | | | | |
| 4 | 5 PDTA | Polymer 1 | 600 | 4.4 | 1.5 | 8.3 ± 0.0 | 85 ± 5 | 84 ± 7 | 91 ± 4 | 81 ± 4 |
| 5 | 5 PDTA | Polymer 1 | 1500 | 12 | 1.5 | | 85 ± 0 | 97 ± 4 | 77 ± 12 | 97 ± 1 |
| 6 | 9.5 TMPD | Polymer 1 | 1000 | 6 | 1.5 | 12.7 ± 1.1 | 82 ± 4 | 98 ± 6 | 87 ± 3 | 92 ± 2 |
| 7 | 3 TMPD | Polymer 1 | 1000 | 6 | 1.5 | 6.2 ± 0.7 | 85 ± 5 | 102 ± 7 | 88 ± 2 | 99 ± 2 |
| 8 | 3 TMPD | co-ord. PO4 | 1500 | 1 PO4 | 0 | 4.2 ± 0.2 | | | | |
| 9 | 0.0 TMPD | Polymer 1 | 600 | 6 | 1.5 | n/a | 87 ± 9 | 92 ± 8 | 86 ± 3 | 107 ± 10 |
| 9 | 1.5 TMPD | Polymer 1 | 600 | 6 | 1.5 | n/a | 84 ± 5 | 94 ± 5 | 85 ± 5 | 98 ± 8 |
| 9 | 3.0 TMPD | Polymer 1 | 600 | 6 | 1.5 | n/a | 83 ± 0 | 91 ± 0 | 97 ± 0 | 96 ± 0 |
| 10 | 0 TMPD | Polymer 1 | 1500 | 12 | 1.5 | | 96 ± 3 | 90 ± 7 | 74 ± 9 | 91 ± 2 |
| 10 | 3 TMPD | Polymer 1 | 1500 | 12 | 1.5 | 5.3 ± 0.0 | 96 ± 2 | 102 ± 2 | 84 ± 6 | 102 ± 2 |
| 11 | 0 TMPD | residual PO4 | 1000 | 3 PO4 | 1.5 | | 15 ± 2 | 12 ± 4 | 69 ± 6 | 86 ± 8 |
| 11 | 3 TMPD | residual PO4 | 1000 | 3 PO4 | 1.5 | 5.1 ± 0.1 | 11 ± 0.7 | 5 ± 0.0 | 63 ± 5 | 62 ± 6 |
| 12 | 0 TMPD | Polymer 1 | 1000 | 6 | 1.5 | n/a | 92 ± 9 | 86 ± 3 | 85 ± 3 | 111 ± 14 |
| 13 | 3 TMPD | Polymer 1 | 1000 | 6 | 1.5 | n/a | 92 ± 2 | 98 ± 3 | 75 ± 3 | 90 ± 5 |
| 14 | 3 TMPD | Polymer 1 | 1000 | 6 | 1.5 | n/a | 85 ± 3 | 88 ± 5 | 89 ± 10 | 110 ± 8 |
| 15 | 0 TMPD | Polymer 1 | 1000 | 6 | 1.5 | n/a | 92 ± 4 | 88 ± 3 | 85 ± 2 | 91 ± 5 |

**Polymer 1 is a copolymer of acrylic acid and acrylamide, about 70/30 mole % AA/AcAm, having weight average molecular of 15,000–40,000, preferably 25,000–30,000.

TABLE II

Scale Boiler Data

| | PSIG | ppm PDTA | ppm TMPD |
|---|---|---|---|
| DADL | 600 | 5 | 0 |
| | 1000 | 5 | 0 |
| | 1500 | 5 | 0 |
| BD | 600 | 0.38 ± 0.09 | 0.22 ± 0.03 |
| | 1000 | 0.22 ± 0.11 | 0.24 ± 0.09 |
| | 1500 | 0.16 ± 0.07 | 0.25 ± 0.01 |
| COND | 600 | 0 | 1.73 ± 0.20 |

TABLE II-continued

Scale Boiler Data

| PSIG | ppm PDTA | ppm TMPD |
|---|---|---|
| 1000 | 0 | 1.67 ± 0.20 |
| 1500 | 0 | 1.88 ± 0.19 |

DADL = Deareator Drop-leg Waters
BD = Blowdown Waters
COND = Condensate Waters

Having described our invention, we claim:

1. method of scavenging oxygen from boiler waters comprising treating said boiler waters with an effective amount of an oxygen scavenging compound, or mixtures of compounds, having the structure:

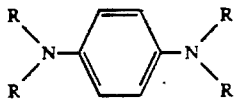

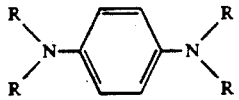

wherein R, at each occurrence, is independently chosen from the group consisting of:

(a) lower linear and branched alkyl groups having from 1–4 carbon atoms;

(b) carboxylated groups having the structure:

$$\text{-}(CH_2)_n\text{-}COOM$$

wherein n is from 1–3, and M is H, alkali metal cations, ammonium or amino cations or mixtures thereof; and (c) or mixtures of the above alkyl groups and carboxylated groups.

2. The method of claim 1 wherein the R group contains from 1–3 carbon atoms.

3. The method of claim 1 wherein the oxygen scavenging compound is chosen from the group consisting of N, N, N', N' tetramethyl-1,4-phenylenediamine and salts thereof, 1, 4-phenylenediamine, N, N, N', N' tetraacetic acid and salts thereof, and mixtures thereof.

4. The method of claim 1 wherein the oxygen scavenging compound is N, N, N',N' tetramethyl-1,4-phenylenediamine, and salts thereof.

5. The method of claim 1 wherein the oxygen scavenging compound is 1,4-phenylenediamine, N, N, N', N' tetraacetic acid, and salts thereof.

6. A method of scavenging oxygen from boiler waters comprising treating said boiler waters with an amine salt of an oxygen scavenging compound having the structure:

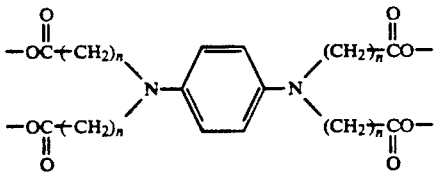

wherein n ranges, independently at each occurrence, from 1–3, and wherein the amine salt is chosen from the group consisting of:

(a) ammonium cation, (b) $N^{(+)}(H)_x(R')_y$, wherein R' is an alkyl or alkoxyl group which may be linear or branched and which may contain from 1 to 20 carbon atoms and x and y both range from 0–4, provided the sum, x + y, is 4;

(c)

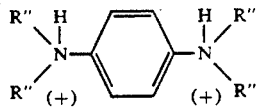

(c)

wherein R'' is chosen independently, at each occurrence, from the group consisting of Hydrogen, lower alkyl groups having from 1–4 carbon atoms; and mixtures thereof.

(d)

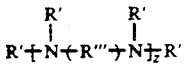

(d)

wherein R' is as above, and z is from 1 to 3, and R''' is chosen from the group consisting of linear or branched alkylene groups having from 1 to 6 carbon atoms, ethoxy groups, propoxyl groups, and mixtures thereof; and (e) mixtures thereof.

7. A method of scavenging oxygen from boiler waters comprising treating said waters with an acid salt of an oxygen scavenging compound having the structure:

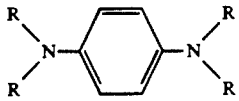

wherein R is independently chosen at each occurrence from lower ($C_1$–$C_4$) alkyl groups, and wherein the acid forming the acid salts is any acid from the group consisting of:

(a) inorganic acids chosen from the group consisting of, hydroxamic acids, $H_3PO_4$, $H_2SO_4$, and mixtures thereof.

(b) organic acids from the group consisting of formic acid, acetic acid, propionic acid, malic acid, maleic acid, citric acid, ethylene diamine tetraacetic acid, nitrilotriacetic acid, and mixtures thereof;

(c) Nitrogen compounds containing at least one carboxylate functional group and having the structure:

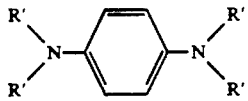

wherein R' is from the group consisting of methyl groups, ethyl groups and $$\text{-}(CH_2)_n\text{-}COOH,$$

where n is from 1–3, providing at least one R' is $$\text{-}(CH_2)_n\text{-}COOH,$$

and (d) amino acids, and (e) mixtures thereof.

8. The method of claims 1, 2, 3, 4, 5, or 6 wherein the boiler waters also contain at least one of the compounds chosen from the group consisting of:

(1) water soluble carboxylate containing polymers having a molecular weight ranging from about 500 to about 50,000, (2) a source of orthophosphate anion, (3) an organic phosphonate compound, (4) Complexing agents chosen from the group consisting of EDTA and NTA, (5) Oxygen scavenging compounds chosen from the group consisting of bisulfite salts, erythorbic acid and its salts, ascorbic acid and its salts, DEHA, hydrazine, methyl ethyl ketoxime 1,3 dihydroxy acetone, gallic acid, hydroquinone, an unsubstituted diaminobenzene, an hydroxy diaminobenzene, carbohydrazide, or mixtures thereof, and (6) mixtures thereof.

9. The method of claims 1,2,3,4,5,6, or 7 wherein the boiler waters are chosen from at least one of the group consisting of boiler fed waters, internal boiler water, boiler condensate waters, boiler deaerator dropleg waters, or any mixture thereof.

* * * * *

UNITED STATES PATENT AND TRADEMARK OFFICE

CERTIFICATE OF CORRECTION

PATENT NO. : 5,091,108

DATED : 2/25/92

INVENTOR(S) : Scott R. Harder, Cynthia A. Soderquist, and Claudia C. Pierce

It is certified that error appears in the above-identified patent and that said Letters Patent is hereby corrected as shown below:

Delete the chemical structure in column 15, line 15 as duplicative.

Signed and Sealed this

Twenty-fifth Day of May, 1993

*Attest:*

Michael K. Kirk

MICHAEL K. KIRK

*Attesting Officer*

*Acting Commissioner of Patents and Trademarks*